United States Patent [19]

Meyer-Ebrecht

[11] 4,420,753

[45] Dec. 13, 1983

[54] CIRCUIT ARRANGEMENT FOR THE TRANSMISSION OF MEASUREMENT VALUE SIGNALS

[75] Inventor: Dietrich Meyer-Ebrecht, Hamburg, Fed. Rep. of Germany

[73] Assignee: U.S. Philips Corporation, New York, N.Y.

[21] Appl. No.: 825,965

[22] Filed: Aug. 19, 1977

Related U.S. Application Data

[63] Continuation of Ser. No. 611,819, Sep. 9, 1975, abandoned.

[51] Int. Cl.[3] ..... G08C 19/12; G08C 19/00; G08C 25/02

[52] U.S. Cl. ..... 340/870.26; 340/870.39; 340/870.42

[58] Field of Search ..... 340/210, 186, 207 R, 340/187, 177 R; 318/564; 323/DIG. 1

[56] References Cited

U.S. PATENT DOCUMENTS

| | | | |
|---|---|---|---|
| 3,387,266 | 6/1968 | Swartwout et al. | 340/187 |
| 3,503,261 | 3/1970 | Riester et al. | 340/210 |
| 3,560,948 | 2/1971 | Inose et al. | 340/210 |
| 3,680,384 | 8/1972 | Grindheim | 340/186 |
| 3,717,858 | 2/1973 | Hadden | 340/210 |
| 3,742,473 | 6/1973 | Hadden | 340/210 |
| 3,898,554 | 8/1975 | Knudsen | 340/186 |

*Primary Examiner*—James J. Groody
*Attorney, Agent, or Firm*—Robert T. Mayer; Bernard Franzblau

[57] ABSTRACT

A circuit arrangement for transmitting signals from a measuring transducer via a two-wire circuit to a receiver which, in turn, via the same two-wire circuit supplies power for operating the transducer. The circuit arrangement comprises a voltage controller, a current switch a current generator, and a power-storage capacitor connected at the transducer end of the two-wire line. The voltage controller supplies the voltage from the two-wire circuit to the measuring transducer as a regulated voltage. Parallel to this the current switch charges the power storage capacitor in the rhythm of the frequency-analog measurement signal. Via the current generator, e.g. an ohmic resistor, the capacitor also receives the voltage input from the measuring transducer. The operating current of the measuring transducer is thus provided partly by the voltage controller and partly by the current generator or resistor. The ratio of these currents determines the modulation depth of the current pulses on the two-wire circuit.

11 Claims, 3 Drawing Figures

CIRCUIT ARRANGEMENT FOR THE TRANSMISSION OF MEASUREMENT VALUE SIGNALS

Figure 1:
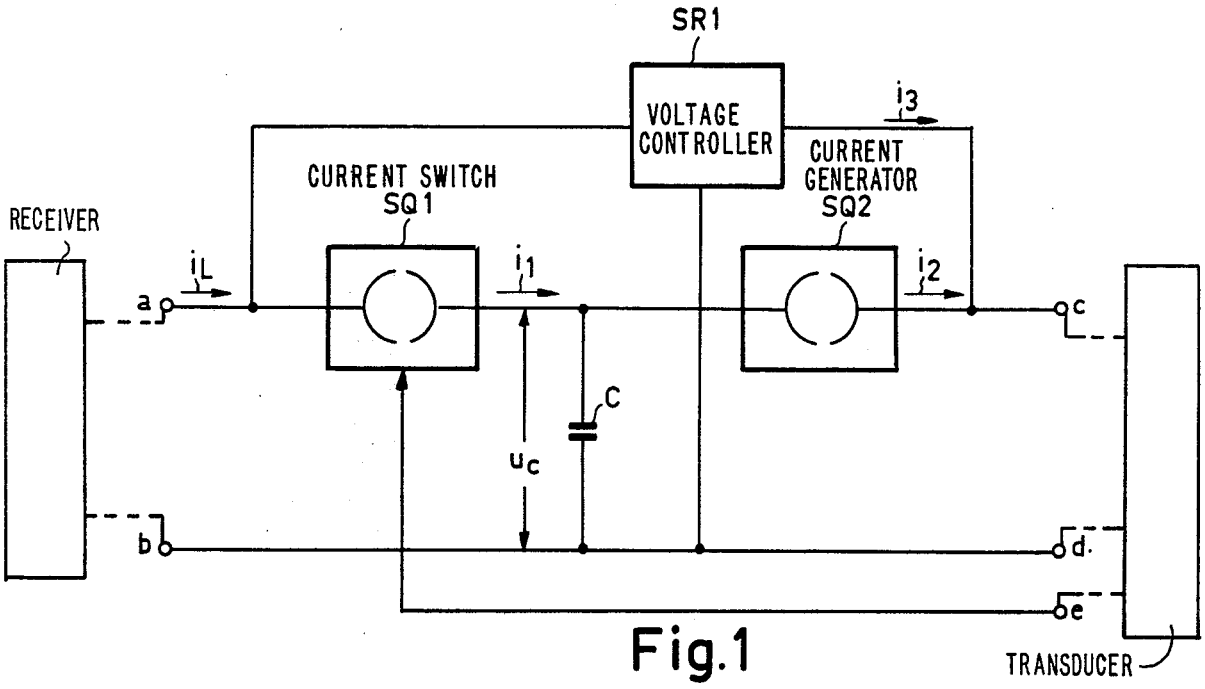
Figure 2A:
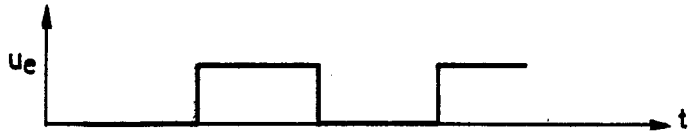
Figure 2B:
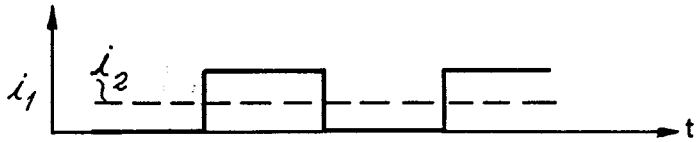
Figure 2C:
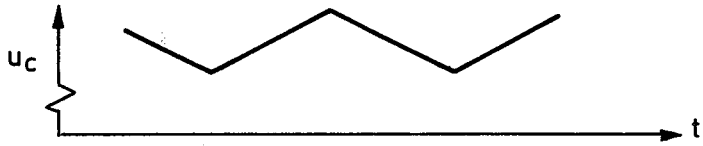
Figure 2D:
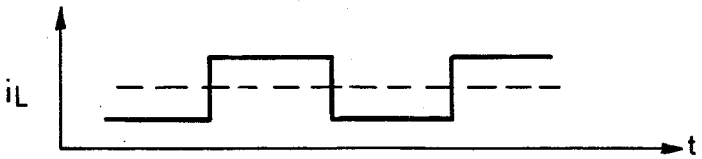

This is a continuation of application Ser. No. 611,819, filed Sept. 9, 1975, now abandoned.

The invention relates to a circuit arrangement for the transmission of measurement value signals from a measuring pick-up device or transducer via a two-wire circuit to a receiver, which two-wire circuit at the same time supplies the electric power from a voltage source in the receiver for the operation of the measuring transducer.

For remote measuring devices in which, in particular, physical quantities are measured by electric means and the electrical measurement signals are transmitted over long distances, the signals supplied by the measuring transducers are frequently not suitable for direct transmission because they are susceptible to transmission errors. For this reason special signal conversion circuits are employed which convert the measurement signals into signals which are immune to interference, for example by amplification of the signals or modulation thereof on an auxiliary carrier. For the operation of these conversion circuits it is generally necessary to transfer auxiliary power to the conversion circuit. In order to dispense with an additional transmission line for this purpose, devices have been realized in which the measuring signals and the auxiliary power are transmitted via the same two-wire circuit. One such device is described in U.S. Pat. No. 3,742,473 issued June 26, 1973 to David M. Hadden and another is described in U.S. Pat. No. 3,387,286 issued June 4, 1968 to C. J. Swartwout et al. This is, for example, effected by adding a current which depends on the measurement value to the constant operating current of the measuring transducer. However, in this respect it is a disadvantage that the overall current consumption substantially increases and that in the measuring transducer a substantial amount of power is converted into heat.

Furthermore, circuit arrangements are known (see for example) the 1972 issue of Electrotechnische Zeitschrift, i.e. ETZ A 93(1972), Volume 10, pages 577–581), in which the measurement signals are converted into alternating electrical quantities whose frequency depends on the measurement value. The so-called "frequency analog" signals obtained with such circuit arrangements exhibit an excellent immunity against normal transmission disturbances.

It is an object of the invention to provide a circuit arrangement by means of which both the auxiliary power for the operation of the measuring transducer as well as the frequency-analog measurement value signal can be transmitted in opposite directions via a single two-wire circuit in a highly accurate manner and without transmitting substantially more current than is required for the operation of the measuring transducer via the two-wire circuit. The invention solves this problem by providing, at the transducer end of the two-wire circuit, a current switch and a voltage controller connected to the terminals of the two-wire circuit. The voltage controller converts the voltage supplied by the receiver between the aforesaid terminals into a constant voltage and applies same to a pair of terminals connected to a measuring transducer which produces a frequency-analog measurement signal. The current switch charges an electric storage device with current pulses produced in rhythm with the frequency-analog signal. By means of a current generator, the storage device supplies a part of the transducer operating current to said pair of terminals. The frequency of the current pulses taken from the receiver voltage source is a measure of the transducer measurement-value signal. Thus, depending on the adjustment of the magnitude and the duration of the current pulses produced by the current switch, a strongly pulsating current is taken from the voltage source in the receiver having a pulse frequency that can be reproduced readily and accurately. The pulse frequency corresponds to the frequency produced by the measuring transducer and thus to the measured value. For power storage a capacitor may be employed whose capacitance is selected so that the pulsating alternating voltage produced at the minimum signal frequency is small relative to the average direct voltage, in which case the current generator for supplying the measuring transducer may be replaced by a simple ohmic resistance. The pulse duty factor of the pulsating current is suitably selected to be approximately 1, and the current generator can supply approximately half the operating current to the measuring transducer so that a satisfactory modulation of the current is obtained.

Figure 3:
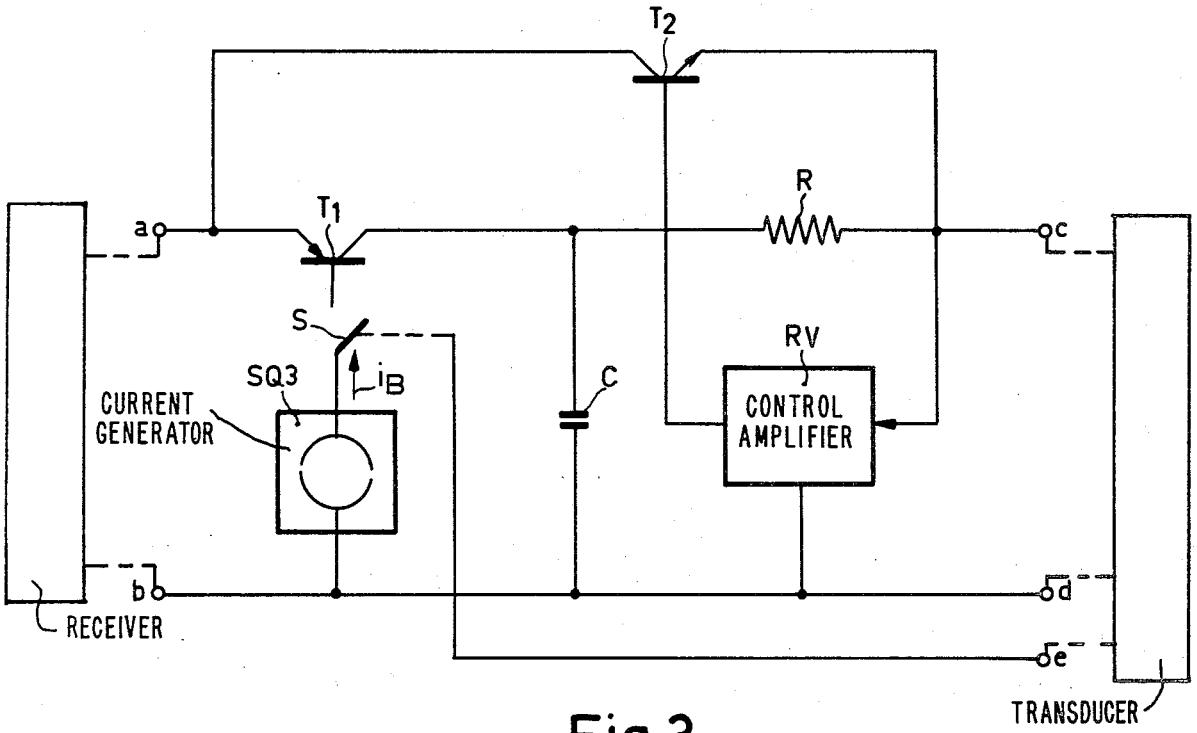

Embodiments of the invention now will be described in more detail with reference to the drawing. In the drawing:

FIG. 1 shows the block diagram of the basic arrangement,

FIGS. 2A–D show the voltage and current variations in the arrangement of FIG. 1, and FIG. 3 shows a more detailed example of an embodiment.

In FIG. 1 the circuit arrangement is connected to the terminals a and b of a two-wire circuit illustrated diagrammatically by a pair of dashed lines coupling terminals a and b to a remote receiver. The terminals c and d represent the operating voltage input of the measuring transducer shown coupled thereto by a second pair of dashed lines, the frequency-analog measurement signal from the transducer being available at the terminal e. The terminals b and d are interconnected and represent the common return line ground.

A voltage controller SR1 is connected to the terminal a. The controller converts the voltage available at said terminal, which voltage may fluctuate slightly owing to the pulsating current, into a constant, effectively smaller voltage and supplies it to the terminal c. Said voltage controller SR1 is suitably adapted to supply a current i3 which equals the maximum operating current of the measuring transducer minus the minimum current i2 from the current generator SQ2, which current is determined by tolerances, but which in the case of errors may also disappear.

Furthermore, a current switch SQ1 is connected to the terminal a. By means of the current switch, a power storage means, which for simplicity is represented as a capacitor C, is intermittently charged in the rhythm of the frequency analog measurement value signal e by the voltage at said terminal. The current generator SQ2 then takes a current i2 from said power storage means as a part of the operating current for the measuring transducer.

The variations of voltages and currents at different points at the block diagram of FIG. 1 are represented in FIG. 2. The voltage $u_e$ at the terminal e, which voltage corresponds to the frequency-analog measuring signal, is represented in the curve a as a square-wave signal with a pulse duty factor 1. The intermittent charging current i of the power-storage means, which is represented by the curve b, then has the same pulse duty factor and thus in the case of loss-free current transmission twice the maximum value of the current i2 taken from the current source SQ2. Conversely, at a given maximum value of the current i1 the current i2 which can be supplied by the current generator SQ2 is determined by control of current switch SQ1.

As in the present case the power storage means is a capacitor C, the intermittent current i1 causes a voltage $U_C$ across said capacitor, which is represented by the curve c in FIG. 2 and which consists of an approximately triangular voltage which is superimposed on the average direct voltage. It is evident that for a sufficiently high value of the capacitor C the amplitude of the triangular voltage can be made sufficiently small relative to the average direct voltage. In general, it suffices when the amplitude is smaller than 10% of the average direct voltage.

The curve d of FIG. 2 represents the current $i_L$ taken from the two-wire circuit. When it is assumed that the current i3 of the voltage controller SR1 essentially equals the current i2 of the current generator SQ2, the current $i_L$ taken from the two-wire circuit (current losses in the voltage controller SR1 being neglected) has a modulation depth of ±b 50%. This modulation depth can be adjusted as required by varying the ratio between the currents i2 and i3, for example by changing the amplitude of the charging current i1.

FIG. 3 shows a more detailed circuit arrangement. Here the current source SQ1 in FIG. 1 is formed by the transistor T1, to the base of which a base current $i_B$ is applied from the current generator SQ3 via the switch S. The switch S is controlled by the frequency-analog measurement signal at terminal e. The current generator SQ2 is in this case realized by means of an ohmic resistor R only, assuming that the capacitance of the capacitor C used as a power storage means is sufficiently high to ensure that the a.c. component appearing across said capacitor is sufficiently small at the lowest measuring frequency, as explained hereinbefore. As the voltage at the terminal c is maintained constant by the voltage controller, which in the present case is constituted by the transistor T2 which is driven by the control amplifier RV, the current which flows through said resistor R is also substantially constant. For a pulse duty factor 1 the voltage across the capacitor C automatically adjusts itself so that the resistor R supplies an average current which equals half the maximum current from the transistor T1, and said last-mentioned current in its turn is determined by the base current $i_B$ from the current source SQ3.

What is claimed is:

1. A circuit arrangement for coupling a measuring transducer to a remote receiver via a two-wire circuit which two-wire circuit at the same time supplies electric power from a remote voltage source for the operation of the measuring transducer, the circuit arrangement comprising, at the measuring transducer end of the two-wire circuit, first and second terminals coupled to the two-wire circuit, a current switch and a voltage controller connected to said first and second terminals of the two-wire circuit, third and fourth terminals connected to the measuring transducer to supply electric power thereto, said voltage controller being responsive to the voltage supplied between said first and second terminals of the two-wire circuit for converting said voltage into a constant voltage which it applies to said third and fourth terminals, said measuring transducer producing a frequency-analog measurement signal whose frequency is determined by the quantity measured by the transducer, electric power storage means, means including the current switch for charging the electric power storage means with current pulses taken from the remote voltage source, said current pulses having a repetition frequency equal to the frequency of the frequency-analog measuring signal so that the frequency of said current pulses is a measure of the transducer measurement-value signal, a current generator, and means including said current generator for coupling the power storage means to said third and fourth terminals so that the power storage means supplies a part of the operating current of the measuring transducer.

2. A circuit arrangement as claimed in claim 1, characterized in that the power storage means supplies approximately half the transducer operating current via the current generator.

3. A circuit arrangement as claimed in claim 1, characterized in that the power storage means comprises a capacitor.

4. A circuit arrangement as claimed in claim 3, characterized in that the capacitance of the capacitor is so high that at the minimum frequency of the measurement-value signal the voltage variation across the capacitor is smaller than 10% of the average voltage across the capacitor.

5. A circuit arrangement as claimed in claim 4, characterized in that the capacitor has first and second terminals and the current generator comprises an ohmic resistor connected between the first terminal of the capacitor and said third terminal, and means connecting the second capacitor terminal to said fourth terminal.

6. A circuit arrangement as claimed in claim 1 characterized in that the on-time of the current switch is approximately equal to the off-time.

7. A circuit arrangement as claimed in claim 1 wherein the amplitude of the current pulses is adjustable.

8. A circuit arrangement as claimed in claim 1 wherein the operating current of the measuring transducer is adjustable.

9. A circuit arrangement that couples a remotely located measuring transducer to a receiver via a two-wire circuit, said circuit arrangement comprising, first and second terminals located at the transducer end of the two-wire circuit and coupled to the two-wire circuit to receive an operating voltage and current for the transducer via the two-wire circuit, third and fourth terminals adapted to be coupled to the measuring transducer, a voltage controller with input means coupled to said first and second terminals and output means coupled to said third and fourth terminals whereby the voltage controller is responsive to the operating voltage supplied to said first and second terminals for converting said voltage into a constant voltage at said third and fourth terminals, an electric storage means, a current switch coupling said first and second terminals to said electric storage means, said transducer producing a frequency-analog measuring signal at a fifth terminal, means coupling said fifth terminal to the current switch for operating said switch at the frequency of the frequency-analog measuring signal and thereby charging said electric storage means by means of a current supplied via said two-wire circuit and at the measuring signal frequency whereby the frequency of the current pulses supplied via the two-wire circuit is a function of said frequency-analog signal, a first current generator, and means including said first current generator for coupling the electric storage means to the third and fourth terminals so that the storage means supplies a part of the transducer operating current.

10. A circuit arrangement as claimed in claim 9 wherein said current switch comprises a transistor having its emitter-collector circuit coupled between said first and third terminals, a switching device operated in synchronism with the frequency-analog signal, and a second current generator coupled to the second terminal and to a control electrode of the transistor via said switching device.

11. A circuit arrangement as claimed in claim 10 wherein the first current generator comprises a resistor, said resistor being connected in series with said transistor between said first and third terminals, and said electric storage means comprises a capacitor having one terminal connected to a junction formed between the transistor and resistor and having a second terminal connected to said second terminal.

* * * * *

UNITED STATES PATENT AND TRADEMARK OFFICE

CERTIFICATE OF CORRECTION

PATENT NO. : 4,420,753

DATED : December 13, 1983

INVENTOR(S) : DIETRICH MEYER-EBRECHT

It is certified that error appears in the above-identified patent and that said Letters Patent is hereby corrected as shown below: Title page:

Insert after Section [22] the following;

-- [30] Foreign Application Priority Data

September 23, 1974 West Germany ..... 2445337 --

Signed and Sealed this

Thirteenth Day of January, 1987

*Attest:*

DONALD J. QUIGG

*Attesting Officer*

*Commissioner of Patents and Trademarks*